US005176813A

United States Patent [19]

Newby

[11] Patent Number: 5,176,813

[45] Date of Patent: Jan. 5, 1993

[54] PROTECTION OF LEAD-CONTAINING ANODES DURING CHROMIUM ELECTROPLATING

[75] Inventor: Kenneth R. Newby, Berkeley Heights, N.J.

[73] Assignee: Elf Atochem North America, Inc, Philadelphia, Pa.

[21] Appl. No.: 609,276

[22] Filed: Nov. 5, 1990

Related U.S. Application Data

[63] Continuation-in-part of Ser. No. 431,963, Nov. 6, 1989, abandoned.

[51] Int. Cl.[5] ..... C25D 3/10

[52] U.S. Cl. ..... 205/284; 205/290

[58] Field of Search ..... 204/51, 43.1; 205/283, 205/284, 290

[56] References Cited

U.S. PATENT DOCUMENTS 4,588,481 5/1986 Chessin et al. ..... 204/51

4,786,378 11/1988 Newby ..... 204/43.1

4,810,337 3/1989 Newby ..... 204/51

OTHER PUBLICATIONS

Dennis, J. K., et al. "Nickel and Chromium Plating" John Wiley & Sons, New York, 1972 pp. 205-206.

*Primary Examiner*—John Niebling

*Assistant Examiner*—Brian M. Bolam

*Attorney, Agent, or Firm*—Stanley A. Marcus; Robert B. Henn

[57] ABSTRACT

The present invention provides a process for electroplating chromium using lead anodes while achieving the advantages of using methanesolfonic acid without suffering the excessive anode-corrosion characteristics associated with that acid. Accordingly, chromium is electrodeposited from a bath containing chromic acid, sulfate and an alkylpolysulfonic acid containing from one to about three carbon atoms. The invention also provides a plating process for chromium electrodeposition, a plating bath for use in the inventive process, and a replenishment composition for existing plating baths.

26 Claims, No Drawings

PROTECTION OF LEAD-CONTAINING ANODES DURING CHROMIUM ELECTROPLATING

CROSS-REFERENCE TO RELATED APPLICATION

This application is a continuation-in-part of my copending U.S. patent application Ser. No. 431,963, filed Nov. 6, 1989 now abandoned.

BACKGROUND OF THE INVENTION

1. Field of the Invention

This invention is in the field of protecting lead anodes from corrosion during metal-electroplating processes. More particularly, this invention provides a process and composition for electroplating chromium, using lead or lead-containing anodes under conditions which produce adherent, bright chromium deposits at high efficiencies, where cathodic low-current-density etching is substantially reduced in comparison with existing high-efficiency catalyst systems. The invention further provides a composition for the replenishment of exhausted or depleted plating baths while diminishing anode corrosion.

2. Description of the Prior Art

Several advantages of certain short-chain alkylsulfonic acids in chromium electroplating have been described for both decorative and functional systems. U.S. Pat. No. 3,745,097 to Chessin, assigned to the same assignee as this invention, discloses decorative electroplating baths containing alkylsulfonic or haloalkylsulfonic acids in combination with certain carboxylic acids to produce bright, iridescent chromium surfaces on the articles plated. In U.S. Pat. No. 4,588,481, Chessin et al. further disclose functional chromium electroplating processes which use baths containing alkylsulfonic acids having a ratio of sulfur to carbon of $\frac{1}{3}$ or greater, but free of carboxylic acids; the processes result in hard, adherent chromium deposits produced at elevated temperatures and high efficiencies without cathodic low-current-density etching. However, the chromium-plating baths taught by U.S. Pat. No. 4,588,481, while yielding the high-efficiency plating described in that disclosure, also resulted in severe problems of scale buildup on, and etching and corrosion of the anode. The disclosure of U.S. Pat. No. 4,588,481 specifies a variety of sulfonic acids, including methane-sulfonic acid (MSA), ethane-sulfonic acid (ESA), methanedisulfonic acid (MDSA) and 1,2-ethane-disulfonic acid (EDSA). Generally for economic reasons, MSA has become the agent of choice in a number of commercial embodiments for chromium plating which have appeared in the marketplace, even though severe scale buildup and anodic corrosion are encountered.

As noted hereinabove, when chromium-plating processes using MSA have been installed and utilized commercially, difficulty has arisen in functional plating using lead or conventional lead-alloy anodes; investigation into the matter of anode corrosion subsequent to the issuance of U.S. Pat. No. 4,588,481 has revealed that MSA in the plating baths generally causes the excessive corrosion of those anodes after extended operation, relative to the corrosion observed in conventional plating processes.

"Conventional plating processes" or "conventional baths" are herein defined as those which are conducted with a plating bath consisting of chromic acid and sulfate ion as the essential ingredients, the sulfate ion generally being provided by sulfuric acid or sodium sulfate, although those are not limiting sources, the requirement being solely that a soluble be provided. It has been found that as a lead anode is used repeatedly in functional chromium electroplating with baths containing MSA, the anode disintegrates at a faster rate than in conventional baths, and it must therefore be replaced much sooner than the anode in an analogous conventional bath. In this specification, the term "lead anode" is intended to define plating-bath anodes formed of lead or lead alloys commonly containing varying percentages of tin or antimony, either alone or in combination with other metals. Such materials are well known to those skilled in the art, and as such form no part of this invention.

In my U.S. Pat. No. 4,786,378, I introduced bismuth, arsenic or antimony ion into the bath with MSA in an attempt to reduce anode corrosion. Thereafter, in U.S. Pat. No. 4,810,337, describing the use of sulfonic acids in electroplating processes, I disclosed one treatment of the anode-corrosion problem described here in connection with the use of MSA. In that patent, I noted that a heavy scale deposit occurs in plating processes using MSA, and applied a relatively high voltage across the electrodes prior to the plating process in order to reduce the observed scale buildup and concomitant corrosion.

Another attempted solution to the problem has been the investigation of materials which are resistant to attack by bath compositions containing MSA. For instance, in German application 3,625,187A, filed on Jul. 25, 1986, anodes made of lead containing up to about 9% by weight of antimony or about 1% by weight of palladium, with or without small amounts of tin, silver and/or selenium are reported to show "good results" when used in functional chromium electroplating processes carried out at 55° C., with a cathodic current density in the range of 30 to 32 amperes per square decimeter (a.s.d.) and an anodic current density of from 25 to 30 a.s.d.

I have also investigated the effect of the purity of MSA on anode corrosion, on the supposition that impurities accompanying MSA might be at least a part of the problem. As noted in connection with Table II hereinbelow, this has been found not to be the case.

The foregoing publications and experimental work indicate at least in part the magnitude of the effect of anode scale and corrosion on plating, and the variety of approaches to its solution. However, until the evaluations leading to the present invention, workers in the art of chromium plating did not recognize that alkylpolysulfonic acids used as plating catalysts could both improve plating efficiency *and* decrease anode corrosion.

MSA and ESA have been generically identified as useful additives in plating baths for functional chromium-plating processes. However, as discussed hereinabove, the relevant references have indicated the problem of severe anodic corrosion when chromium is functionally electroplated for an extended period of time with lead anodes in plating baths containing MSA, the industry standard. Significantly, those references fail to suggest or disclose any particular means for an economical solution to the problem without sacrificing cost or process efficiency, or the other advantages obtained using baths containing MSA.

SUMMARY OF THE INVENTION

The present invention provides a process of and composition for functionally electroplating chromium from a high-efficiency, etch-free plating bath onto a basis-metal cathode with a lead anode under conditions which substantially reduce or eliminate excessive corrosion of the anode by the plating bath after extended use, which process comprises contacting the basis-metal cathode and the lead anode with a plating bath consisting essentially of chromic acid and sulfate in amounts sufficient to obtain a useful deposit of chromium, and at least one alkylpolysulfonic acid, halogenated alkylpolysulfonic acid, or salt thereof, which acid or salt contains from one to about three carbon atoms, and electrodepositing chromium at a cathode efficiency of at least 20% at a current density of about 30 a.s.d. and a plating temperature of from about 45° to about 70° C. for a time sufficient to obtain a desired functional chromium deposit, in the substantial absence of a corrosion-producing monosulfonic acid, such that there is minimal cathodic low-current-density etching. As used herein, the term "substantial absence of a corrosion-producing monosulfonic acid" is used to mean the inclusion in the plating bath of amounts of one or more monosulfonic acids or salts, whether added to the bath or formed in situ, which acids or salts are insufficient to cause anode corrosion greater than that encountered in conventional plating baths.

DESCRIPTION OF THE PREFERRED EMBODIMENTS

The preferred embodiment of the present invention is the composition for securing chromium electroplated from an etch-free, high-efficiency, plating bath onto a basis-metal cathode with a lead anode in the substantial absence of corrosion-causing amounts of monosulfonic acids, which composition comprises chromic acid and sulfate ion in amounts sufficient to obtain the desired deposit of chromium, and at least one alkylpolysulfonic acid, halogenated alkylpolysulfonic acid, or salt thereof, which acid or salt contains from one to about three carbon atoms. The process of this invention comprises contacting a basis-metal cathode and a lead anode with a plating bath consisting essentially of chromic acid and sulfate ion in amounts sufficient to obtain a useful deposit of chromium, and at least one alkylpolysulfonic acid, halogenated alkylpolysulfonic acid, or salt thereof, which acid or salt contains from one to about three carbon atoms, and electrodepositing chromium at a cathode efficiency of at least 20%, at a current density of from about 11 to about 230 a.s.d., and at a plating temperature of about 45° to about 70° C. for a time sufficient to obtain a bright, adherent chromium deposit.

In the course of attempting to reduce anode corrosion in chromium-plating processes, it has surprisingly been discovered that substantial replacement of MSA by certain alkylpolysulfonic acids in chromium electroplating baths for use with lead anodes dramatically reduces the amount of anode corrosion without sacrificing plating efficiency or chromium adherence. Specifically, the use of the alkylpolysulfonic acids or salts thereof of the present invention enables the production of useful chromium-plated items; i.e., those whose characteristics are at least as good as those obtained in the course of high-efficiency baths of the prior art.

The benefits of the present invention may be realized by the use in the plating bath of at least one material selected from the group consisting of alkylpolysulfonic acids containing from one to about three carbon atoms, halogenated alkylpolysulfonic acids, and salts of such acids and halogenated acids, which acids or salts contain from one to about three carbon atoms. Halogenated acids are those containing fluorine, chlorine, bromine or iodine bound to a carbon atom; fluorine- and chlorine-substituted derivatives are preferred. Representative acids and salts include MDSA, mono- and dichloromethanedisulfonic acid, 1,1-ethanedisulfonic acid, and monochloro- or 1,2-dichloroethanedisulfonic acid and their salts, provided that there is no precipitation of chromium or sulfate moieties caused by the addition of the salt. Preferred cations are chosen from alkali metals. Particularly preferred are sodium and potassium salts. The alkylpolysulfonic acids or salts of the present invention have the formula $$R_a-[\underset{\underset{X_b}{|}}{C_n}-(SO_2OH)_y]_m$$

where a and b are independently from 0 to 2, n is from 1 to 3, m and y are independently from 1 to 3, provided that the total number of sulfonic groups in the molecule is not less than 2, X is halogen or oxygen, R is unsubstituted lower alkyl or substituted lower alkyl, where the substitutents on R are halogen or oxygen, and where hydrogen occupies any positions otherwise unaccounted for, i.e., to satisfy unfilled valences of carbon or oxygen. Those skilled in the art will realize that the salts of this invention can be formed by the replacement of the labile hudrogen of the sulfonic group by a metal, such as, e.g., sodium, potassium, or the like.

As set forth in the formula above, the alkylpolysulfonic acids of this invention contain at least two sulfonic acid groups connected to carbon, and any one carbon atom can have up to three sulfonic acids groups attached thereto.

In the utility of the present invention, the polysulfonic acids or salts thereof are incorporated into a functional chromium-plating bath in substantially catalytic amounts. Within the scope and spirit of this invention, and depending upon plating conditions, that amount has been determined to be from about 0.25 to about 40 grams per liter (g/l), and preferably from about 1 to about 12 g/l, of an alkylpolysulfonic acid, halogenated alkylpoly-sulfonic acid or salt thereof. Particularly preferred amounts range from about 2 to about 8 g/l. In a preferred embodiment, the alkylpolysulfonic acid is MDSA.

As used in this specification, "excessive corrosion" is that amount of corrosion perceptibly in excess of the corrosion observed in conventional plating processes. "Extended" use is the amount of use of a lead anode in a conventional system which leads to detectable corrosion of that anode.

The present invention further provides a functional chromium-plating system comprising a lead anode, a basis-metal cathode and a plating bath consisting essentially of chromic acid and sulfate ion, and at least one alkylpolysulfonic acid, halogenated alkylpolysulfonic acid, or a salt thereof, which acid or salt contains from one to about three carbon atoms, in amounts sufficient to obtain efficient functional electrodeposition, the bath being capable of producing bright, adherent chromium deposits while maintaining minimal cathodic low-current-density etching in the substantial absence of monosulfonic acids. "Efficient functional electrodeposition" occurs, for example, at cathode efficiencies of at least 20% at 30 a.s.d. and 55° C. A "corrosion-inhibiting amount" of added bath material is that amount which provides enhanced plating efficiency over conventional plating baths while avoiding electrolytic or chemical attack at an electrode.

The present invention provides a functional chromium electroplating bath which is useful to produce bright, adherent chromium deposits at high efficiencies, but which substantially avoids the excessive anode corrosion which is characteristic of industrial baths containing MSA, the inventive bath consisting essentially of chromic acid and sulfate in amounts sufficient to obtain efficient functional electrodeposition, and at least one alkylpolysulfonic acid, halogenated alkylpolysulfonic acid, or a salt thereof, which acid or salt contains from one to about three carbon atoms, and is substantially free of monosulfonic acids. As used herein, the term "substantially free", when applied to monosulfonic acids, is chosen to mean a concentration of monosulfonic acid low enough not to cause a detectable rate of corrosion higher than that experienced in a conventional plating bath consisting essentially of chromic acid and sulfate ion, in amounts sufficient to obtain a useful deposit of chromium.

The functional chromium electroplating baths of this invention consist essentially of chromic acid, sulfate ion and at least one alkylpolysulfonic acid, halogenated alkylpolysulfonic acid or salt thereof. Useful chromic acid amounts range from about 100 to about 450 g/l, preferred ranges being from about 200 to about 300 g/l. Sulfate ion is incorporated in amounts ranging from about 1 to about 5 g/l, and preferably ranging from about 1.5 to about 3.5 g/l.

The electroplating baths may include other ingredients which do not substantially affect process efficiency, chromium adherence or brightness in a negative manner. Such additives may be incorp-orated to improve handling of the baths, such as, e.g., fume suppressants, brightening agents and the like.

The functional electroplating process is carried out at plating temperatures typically exceeding 40° C. In a preferred embodiment, current density is from about 50 to about 100 a.s.d. at a plating temperature of from about 45° to about 70° C. Current den-sities of from about 11 to about 230 a.s.d. are suitable in the process of this invention, while densities of from about 50 to about 100 a.s.d. are preferred. Plating efficiencies of at least 20% are easily achieved, with values of from about 22 to about 28% being typical under the described most-preferred conditions.

The functional electroplating system of the present invention includes a lead anode, a cathode generally comprising a work-piece for plating, and the chromium electroplating bath as described above. Typical cathode items include crankshafts, piston rings and the like. As previously noted, typical anode materials include substantially pure lead, but are more generally alloys containing lead in combination with tin, antimony, tellurium and a variety of other metals, either singly or in combination. In the nomenclature of the examples herein, a term such as "Pb-7% Sn" is a tin-lead composition being primarily lead, and having about 7% tin by weight as the alloying metal. In such compositions, there may further be minor amounts of other materials present.

The utility of this invention is shown by the following examples, which are illustrative rather than limiting:

EXAMPLE 1

Accelerated anode-corrosion tests were conducted using previously weighed Pb-7% Sn anodes in several different chromium-plating baths as described here:

(a) a conventional chromium-plating bath (chromic-acid:sulfate-ion ratio of 100:1);

(b) an analogous bath containing chromic acid, sulfate ion and MSA; and (c) a bath according to the present invention, containing MDSA as a representative disulfonic acid in place of MSA.

Extended bath usage was simulated by plating at 60° C. at an anode current density of 0.5 a.s.d. for 30 minutes, followed by 30 minutes of non-plating. This process was conducted for about eight hours and the power turned off overnight, during which time the bath was allowed to cool. These steps were repeated for a period of several weeks; the anodes were occasionally removed, dried, weighed and then re-inserted into the bath. The results are given in Table I.

TABLE I

| | Electroplating Bath | Anode Weight Loss (g) 600 amp-hrs | 1605 amp-hours |
|---|---|---|---|
| (a) | Conventional (250 g/l chromic acid; 2.5 g/l sulfate ion) | 13.32 | 37.35 |
| (b) | MSA (bath [a] with 3.0 g/l MSA) | 16.29 | 41.77 |
| (c) | MDSA (bath [a] with 3.2 g/l MDSA (Na salt)) | 13.41 | 37.31 |

It is seen that in bath (c), containing MDSA as set forth herein for use in the process of this invention, anode corrosion remains substantially at the level of a conventional chromium-plating bath (a), whereas bath (b), with MSA as the plating-improvement medium, leads to corrosion at a substantially higher rate. In bath (b), there was evidence of serious interfacial attack on the anode, while in the conventional bath (a) and inventive bath (c), the appearance of the anode was substantially unaffected by the plating process. The quality of the deposit obtained with the inventive bath was at least as good as, and possibly somewhat harder than, the plating achieved with either the conventional commercial plating bath or that containing MSA.

EXAMPLE 2

In a second type of accelerated test, a measured direct current was applied to the Pb-7% Sn anode in bath solutions deliberately kept low in chromic acid and high in MSA or MDSA. The percentage of current which formed soluble products (i.e., the percentage of current leading to corrosion) was determined by measuring actual anode weight loss and dividing that value by the weight loss predicted by Faraday's Law; this calculation assumed that all weight loss resulted from the corrosion reaction Pb→Pb(II). The results are presented in Table II.

TABLE II

| Material | Concentration, Moles/Liter 0.13 | 0.25 |
|---|---|---|
| | Current, Percent | |
| Chromic Acid, 100 g/l (control) | 0.61 | 0.61 |
| 70% assay MSA | 1.64 | 3.40 |
| 99.9% assay MSA, sample 1 | 1.72 | 5.79 |
| ESA | 2.29 | 3.81 |
| 1-Propanesulfonic acid | 3.18 | 5.76 |
| 1-Butanesulfonic acid | 6.30 | 5.56 |
| Methanedisulfonic acid disodium salt | 0.72 | 0.79 |
| 1,2-Ethanedisulfonic acid sodium salt | 0.55 | 0.35 |
| 2-Propanesulfonic acid sodium salt | 1.90 | 3.67 |
| 2-Chlorosulfonic acid sodium salt monohydrate | 1.55 | 3.19 |
| 2-Ketopropane-1,3-disulfonic acid dipotassium salt | 0.51 | — |

It will be observed from a consideration of the foregoing table that the teaching of a sulfur-to-carbon ratio of $\frac{1}{3}$ in Chessin et al. in U.S. Pat. No. 4,588,481 was in fact overbroad. Both the ethane- and propanesulfonic acids, while adequate plating catalysts falling squarely within the disclosed limits of Chessin et al., also promote unacceptable levels of corrosion in chromium-plating baths.

These results also demonstrate that corrosion of the anode in the presence of MDSA is substantially the same as the conventional bath, whereas the presence of MSA caused substantially increased anode corrosion.

The present invention has further utility as a replenishment composition for existing operations. Specifically, a composition consisting essentially of chromic acid in amounts sufficient to replenish what has been consumed in plating, and at least one alkylpolysulfonic acid, halogenated alkylpolysulfonic acid, or salt thereof is useful for addition to a functional chromium-plating installation to improve plating efficiency with concomitant decrease in anode corrosion, even where the existing installation is operating with baths of the prior art.

In particular, utility in accordance with this invention has been found in a replenishment composition for a chromium-plating bath having chromic acid and at least one alkylpolysulfonic acid, halogenated alkylpolysulfonic acid or salt thereof in amounts from about 1 to about 40 g per kilogram (kg) of $CrO_3$, and preferably from about 2 to about 25 g per kg, of replenishment composition. This composition can be either a solid mixture or a solution. Those skilled in the art will realize that the chromium can be present as the oxide, the acid or a salt, and that the amount of chromium is calculated and expressed for convenience as $CrO_3$, irrespective of the exact nature of the chromium-containing material present.

Modifications and improvements to the preferred forms of the invention disclosed and described herein may occur to those skilled in the art who come to understand the principles and precepts hereof. Accordingly, the scope of the patent to be issued hereon should not be limited solely to the embodiments of the invention set forth herein, but rather should be limited only by the advance by which the invention has promoted the art.

What is claimed is:

1. The process of electroplating chromium from a high-efficiency, etch-free plating bath onto a basis-metal cathode with a lead anode in the substantial absence of a corrosion-producing monosulfonic acid, which comprises contacting a basis-metal cathode and the lead anode with a plating bath consisting essentially of chromic acid and sulfate ion in amounts sufficient to obtain the desired deposit of chromium, and at least one alkylpolysulfonic acid, halogenated alkylpolysulfonic acid, or salt thereof, which acid or salt contains from one to about three carbon atoms, and electrodepositing chromium at a cathode efficiency of at least 20% at a current density of at least 30 a.s.d. and at a plating temperature of about 45° to about 70° C. for a time sufficient to obtain a bright, adherent chromium deposit.

2. A process according to claim 1 wherein the plating temperature is from about 50° to about 60° C.

3. A process according to claim 1 wherein the cathode efficiency is from about 22 to about 28% and the current density is between about 45 and about 90 a.s.d.

4. A process according to claim 1 wherein the amount of chromic acid in the plating bath is from about 100 to about 450 g/l.

5. A process according to claim 4 wherein the amount of chromic acid is from about 200 to about 300 g/l.

6. A process according to claim 1 wherein the alkylpolysulfonic acid or salt is selected from the group consisting of methanedisulfonic acid, mono- and dichloroethane 1,2-disulfonic acid, 1,1-ethanedisulfonic acid, and mono- and dichloromethanedisulfonic acid and salts thereof.

7. A process according to claim 6 wherein the alkyldisulfonic acid or salt is present in the bath in an amount ranging from about 0.5 to about 20 g/l.

8. A process according to claim 7 wherein the amount is from about 1 to about 12 g/l.

9. A process according to claim 8 wherein the amount is from about 2 to about 8 g/l.

10. A process according to claim 6 wherein the alkylpolysulfonic acid is methanedisulfonic acid.

11. A process according to claim 10 wherein the methanedisulfonic acid is present in an amount from about 2 to about 8 g/l.

12. A process according to claim 1 wherein the sulfate amount is from about 1 to about 5 g/l.

13. A process according to claim 12 wherein the sulfate amount is from about 1.5 to about 3.5 g/l.

14. A process according to claim 1 wherein the current density is from about 15 to about 100 a.s.d.

15. A chromium plating process which comprises electroplating from a bath comprising a lead anode, a basis-metal cathode and a plating bath consisting essentially of chromic acid and sulfate in amounts sufficient to obtain efficient functional electrodeposition in the substantial absence of a corrosion-producing monosulfonic acid, and at least one alkylpolysulfonic acid or salt having the formula $$R_a-[\underset{\underset{X_b}{|}}{C_n}-(SO_2OH)_y]_m$$

where a and b are independently from 0 to 2, n is from 1 to 3, m and y are independently from 1 to 3, provided that the total number of sulfonic groups in the molecule is not less than 2, X is halogen or oxygen, R is unsubstituted lower alkyl, or substituted lower alkyl where the substituents on R are halogen or oxygen, and where hydrogen occupies any positions otherwise unaccounted for on carbon or oxygen, the bath producing bright, adherent chromium deposits.

16. A process according to claim 15 wherein the amount of chromic acid in the plating bath is from about 100 to about 450 g/l.

17. A process according to claim 16 wherein the amount of chromic acid is from about 200 to about 300 g/l.

18. A process according to claim 15 wherein the alkylpolysulfonic acid or salt is selected from the group consisting of methanedisulfonic acid, mono- or dichloro methanedisulfonic acid, 1,1-ethanedisulfonic acid, mono- or dichloroethanedisulfonic acid, and alkali-metal salts thereof.

19. A process according to claim 18 wherein the alkylpolysulfonic acid or salt is present in the bath in an amount from about 0.5 to about 20 g/l.

20. A process according to claim 19 wherein the amount is from about 1 to about 12 g/l.

21. A process according to claim 20 wherein the amount is from about 2 to about 8 g/l.

22. A process according to claim 18 wherein the alkylpolysulfonic acid is methanedisulfonic acid.

23. A process according to claim 22 wherein the amount is from about 2 to about 8 g/l.

24. A process according to claim 15 wherein the sulfate amount is from about 1 to about 5 g/l.

25. A process according to claim 24 wherein the sulfate amount is from about 1.5 to about 3.5 g/l.

26. A process according to claim 15 having a current density of from about 30 to about 100 a.s.d.

* * * * *